US006107259A

United States Patent [19]

Muir et al.

[11] Patent Number: 6,107,259

[45] Date of Patent: Aug. 22, 2000

[54] OIL SOLUBLE CALCITE OVERBASED DETERGENTS AND ENGINE OILS CONTAINING SAME

[75] Inventors: Ronald J. Muir, West Hill; Theo I. Eliades, Scarborough; Ken Niece, West Hill; Wayne A. Mackwood, Ajax, all of Canada

[73] Assignee: Witco Corporation, Greenwich, Conn.

[21] Appl. No.: 09/115,792

[22] Filed: Jul. 15, 1998

[51] Int. Cl.[7] ..... C10M 159/24

[52] U.S. Cl. ..... 508/393; 508/460; 508/586

[58] Field of Search ..... 508/393, 460, 508/586

[56] References Cited

U.S. PATENT DOCUMENTS

| | | | |
|---|---|---|---|
| 3,372,115 | 3/1968 | McMillen | 508/393 |
| 3,377,283 | 4/1968 | McMillen | 508/393 |
| 3,446,736 | 5/1969 | Herd et al. | 508/393 |
| 3,766,067 | 10/1973 | McMillen . | |
| 3,816,310 | 6/1974 | Hunt | 252/33 |
| 4,328,111 | 5/1982 | Watson et al. | 508/393 |
| 4,487,704 | 12/1984 | Yamaguchi et al. . | |
| 4,560,489 | 12/1985 | Muir et al. | 252/33.4 |
| 4,597,880 | 7/1986 | Eliades | 252/33.4 |
| 4,615,813 | 10/1986 | Bretz . | |
| 4,668,409 | 5/1987 | Yamaguchi et al. . | |
| 4,780,224 | 10/1988 | Jao . | |
| 4,822,502 | 4/1989 | Muir | 252/33.4 |
| 4,824,584 | 4/1989 | Muir et al. | 252/39 |
| 4,929,373 | 5/1990 | Powers, III et al. . | |
| 4,995,993 | 2/1991 | Papke et al. | 252/25 |
| 5,108,630 | 4/1992 | Black et al. . | |
| 5,132,033 | 7/1992 | Jao et al. . | |
| 5,213,697 | 5/1993 | Vinci et al. | 508/393 |
| 5,244,957 | 9/1993 | Best et al. . | |
| 5,308,514 | 5/1994 | Olson et al. | 252/18 |
| 5,332,776 | 7/1994 | Best et al. . | |
| 5,338,346 | 8/1994 | Luttinger et al. . | |
| 5,338,467 | 8/1994 | Olson et al. | 508/393 |
| 5,439,602 | 8/1995 | Eckard et al. . | |
| 5,919,741 | 7/1999 | Jaynes et al. | 508/460 |

FOREIGN PATENT DOCUMENTS

| | | |
|---|---|---|
| 2146348 | 9/1984 | United Kingdom . |

OTHER PUBLICATIONS

Study of boundary film formation with overbased calcium sulfonate by PM–IRRAS spectroscopy, Giasson et al., Thin Solid Films, 252 (1994) pp. 111–119.

*Primary Examiner*—Jerry D. Johnson
*Attorney, Agent, or Firm*—Lackenbach Siegel

[57] ABSTRACT

An engine oil contains a lubricating oil and an overbased calcium sulfonate having a dispersion of calcite-core micelles, which engine oil has commercial haze free properties, namely a Hazitron test value of less than about 30 and more particularly less than about 15 to 10, and commercial anti-wear properties, namely exhibiting a 4-Ball wear test scar diameter of less than 0.4 mm. The detergent has a TBN of from 100 to 400 and yet a viscosity of no more than 100,000 cps at 25° C. and usually 20,000 to 30,000 cps at 25° C. The overbased calcium sulfonate detergent provides a stable dispersion of calcite-core sulfonate micelles in the oil. The calcite overbased sulfonate is substantially free of amorphous, vaterite and aragonite forms of the calcium carbonate. The method of producing the improved calcite-core dispersion overbased calcium sulfonate provides for reacting an overbased amorphous calcium sulfonate having a TBN of about 400 or more with a $C_1$ to $C_6$ carboxylic acid or salt, such as acetic acid or calcium acetate, a $C_1$ to $C_5$ alkanol such as, methanol, and water, in a hydrocarbon solvent or oil, at closely controlled temperatures up to and to commensurate with the boiling point of the hydrocarbon solvent for usually about up to 1½ hours to convert the amorphous calcium carbonate to a stable dispersion of a calcite-core micellar structure.

40 Claims, No Drawings

OIL SOLUBLE CALCITE OVERBASED DETERGENTS AND ENGINE OILS CONTAINING SAME

FIELD OF THE INVENTION

This invention relates to engine oils. This invention also relates to overbased detergents, particularly including overbased metal sulfonates, providing improved anti-wear in a lubrication oil, and to the method of making such overbased detergents.

BACKGROUND OF THE INVENTION

The term "engine oil" as used hereinbefore and hereinafter means a lubricating oil that may be useful in an engine oil, and by way of example, includes an automotive oil or diesel engine oil, including both formulated and virgin oils.

Among the materials that impart detergency to lubricating oils to keep internal engine parts clean and reduce sludge formation in the oil are overbased detergents, particularly calcium sulfonates. These sulfonates are known to be useful as additives for lubricating oils, particularly as a crankcase engine oil for internal combustion engines.

It is known that equivalent detergency characteristics can be obtained with a lower concentration of additive in a lubricating oil—the higher the alkaline reserve of an additive: the larger the quantity of acidic combustion products accumulated in the oil to which the additive is added that can be neutralized by the additive. The measurement of alkaline reserve is reported as total base number (TBN) which is the number of milligrams of potassium hydroxide equivalent to the amount of acid required to neutralize the alkaline constituents present in one gram of sample. An additive having a total base number higher than can be obtained from calcium petroleum sulfonate alone is commonly said to be "over-based" or, alternatively, is said to be "superbasic".

Overbased calcium sulfonates are generally produced by carbonating a mixture of hydrocarbons, sulfonic acid, calcium oxide or calcium hydroxide and promoters such as methanol and water. In carbonation, the calcium oxide or hydroxide reacts with the gaseous carbon dioxide to form calcium carbonate. The sulfonic acid is neutralized with an excess of CaO or $Ca(OH)_2$ to form the sulfonate. The prior art known processes for overbasing calcium sulfonates produce high alkaline reserves of TBN of 300 to 400 mg KOH/gm or higher, which enables the formulator to use lower amounts of additive while maintaining equivalent detergency to protect the engine adequately under conditions of high acid formation in the combustion process.

The calcium carbonate component of the overbased calcium sulfonate forms the core of a calcium sulfonate micellar structure. The calcium carbonate is either in the amorphous and/or one or more of its crystalline forms particularly, calcite.

Papke, et al., U.S. Pat. No. 4,995,993, recognized that large micellar crystalline calcium carbonate structures caused haze, and overbased sulfonate products containing crystalline calcium carbonates are always undesirable and therefore crystallization was to be avoided at all costs. See, Papke, et al. at col. 4, lines 39–42. Papke, et al. consequently directed one to a product that contains an amorphous calcium carbonate core micellar structure of 100 to 150 Angstroms in size for 400 TBN products, whereas crystalline-core calcium sulfonates were found to always have large micellar sizes of 400 to 600 Angstroms. See, Papke, et al. at col. 4, line 53 to col. 5, line 5. Papke, et al. also found that even where small crystalline-core calcium sulfonate micelles were first formed, agglomeration readily effected undesired large micelles. See, Papke, et al., e.g. at col. 5, lines 4–14. The prior art could not tolerate more than about 1% by weight of calcite in a lubricating oil.

It was also recognized in the art, as disclosed in "Colloidal anti-wear additives 2. Tribological behavior of colloidal additives in mild wear regime," J. L. Mansot, et al., *Colloids and Surfaces A: Physico Chemical and Engineering Aspects*, 75 (1993), pp. 25–31, that overbased micelles composed of an amorphous calcium carbonate core surrounded by calcium didodecylbenzene sulfonate molecules strongly bonded to the core, when in a 2% by weight dispersion in dodecane, and subjected to metallic friction surfaces, the calcium carbonate forms a polycrystalline film adherent to the metallic friction surfaces, which resultantly provides anti-wear protection. Mansot, et al. thereby directed one to providing an overbased calcium sulfonate with an amorphous micellar structure which would then, under a mild wear regime, undergo transformation to microcrystalline agglomerates through an amorphous intergranular phase. Mansot, et al., in this manner, further confirmed the direction of the prior art to providing amorphous calcium carbonate micellar dispersion overbased calcium sulfonate detergents.

Prior art crystalline overbased calcium sulfonates were hazy and not oil soluble. Such prior art crystalline overbased calcium sulfonates are disclosed in U.S. Pat. No. 4,560,489 to Muir, et al.; U.S. Pat. No. 3,242,079 to McMillen; and U.S. Pat. No. 3,376,222 to McMillen. These products were used as additives for greases, paints (for rheology control) and in extreme pressure (EP) metal working formulations. The prior art calcite overbased calcium sulfonates, such as disclosed in Muir, et al. were hazy and had particle sizes ranging from 50 Angstroms up to 5,000 Angstroms, with minimum viscosities of 1 million to 10 million cps at 25° C. Typically, products containing such calcite overbased calcium sulfonates were rheology modified greases.

In the art directed to extreme pressure (EP) lubricants, particularly including metal working fluids and greases, where haze free aesthetics was not a commercial consideration, it was known to provide calcite-core overbased calcium sulfonate detergents for improved anti-wear properties. That is, it was recognized that the calcite contributed to improved anti-wear in such lubricants. These lubricants however were hazy, and for the foregoing and following reasons were precluded from use in automotive crankcase or like engine oils.

The lubricating oil art, particularly as directed to automotive crankcase and other engine oils, mandated a clear or substantially haze free product for requisite consumer aesthetics and acceptance. This need precluded the use of prior art detergents with haze producing crystalline calcium carbonate. The art recognized haze test was the Hazitron test, as further discussed hereinafter. Hazitron test values of generally less than 30, and more usually less than about 15 to 10, were considered commercially substantially haze free and acceptable. Additionally, engine oils desirably had reduced turbidity, as measured by a turbidimeter, of below 100, preferably below 40 to 60, and most preferably below 25.

The automotive engine or motor oil art solution to providing requisite anti-wear was the addition of a zinc dithiophosphate (ZDP) to the motor oil. While ZDP provided anti-wear improvement, it was an otherwise undesirable solution in that; (1) ZDP attacked the catalyst in a catalytic converter which in turn resulted in pollution emissions, and (2) ZDP effectiveness was reduced by the co-presence of the overbased hydrocarbyl sulfonates (as discussed in e.g., Yamaguchi, et al., U.S. Pat. No. 4,668,409). In order for motor oils to pass the mandated engine tests, the motor oils required at least about 0.1% by weight phosphorous (P) ZDP.

The art desired a lubricating oil detergent with inherent improved anti-wear properties, which also necessarily had commercially acceptable levels of minimal haze, or were essentially haze free, and with acceptable minimal levels of turbidity. The automotive oil art particularly desired an as aforesaid improved anti-wear detergent for use as a crankcase engine oil.

SUMMARY OF THE INVENTION

An overbased detergent, particularly including a calcium sulfonate, has a calcite-core micellar dispersion. The calcite overbased calcium sulfonate detergent is soluble in lubricating oils in detergent amounts, and from about 0.1 to 10% by weight or more at room temperature. The calcite overbased calcium sulfonate has a TBN of 100 to 400, and generally a calcium sulfonate content of at least about 12 to 17% by weight, and a viscosity of less than 100,000 cps at 25° C. The calcite overbased calcium sulfonate is substantially free of amorphous, vaterite and aragonite forms of calcium carbonate. An engine oil containing such calcite-core dispersion detergents has a commercially acceptable haze free and turbidity values, and also has commercially desired anti-wear properties. Specifically, the resultant engine oil has a Hazitron test result or value of less than 30 and usually less than 15 to 10, and a 4-Ball wear test (ASTM D4172) scar diameter of less than about 0.4 mm.

In another aspect, the invention comprises a method for making the stable calcite-core micellar dispersion overbased calcium sulfonate, which is substantially haze free. The method generally comprises reacting an overbased amorphous calcium sulfonate, with a $C_1$ to $C_5$ alkanol, a $C_1$ to $C_6$ carboxylic acid or salt and water, in a hydrocarbon solvent or oil, at closely controlled temperatures up to and commensurate with the boiling point of the hydrocarbon solvent. The alkanol is preferably methanol, and the carboxylic acid or salt is preferably acetic acid or calcium acetate. The hydrocarbon solvent is preferably a 500 SUS oil and wherein the calcite conversion parameters are 150° to 160° F. for up to 1½ hours or more to convert the amorphous-core overbased detergent to calcite-core overbased detergent.

DESCRIPTION OF THE INVENTION

Calcite Conversion

The starting material for the calcite conversion is an overbased calcium sulfonate which has an amorphous calcium carbonate-core micellar structure. This starting overbased calcium sulfonate is highly overbased and has a TBN of at least 300 to 350 and most preferably in excess of 400. Such highly overbased amorphous calcium sulfonates are well known and may be produced by any of the methods well known in the art. Commercially available amorphous calcium sulfonates are useful starting materials. Witco HYBASE C402 is a preferred TBN 400 amorphous overbased calcium sulfonate (HYBASE and LOBASE are trademarks of Witco Corp.).

In general the process of preparing such overbased calcium sulfonates comprises reacting a solution of alkylbenzene sulfonic acids having a molecular weight greater than 400, in oil with a slurry of calcium oxide or hydroxide and bubbling carbon dioxide through the reaction mixture; thereby incorporating an excess of calcium carbonate into the calcium sulfonate which confers the desired reserve alkalinity to the product. In this process it has been found advantageous to add a low molecular weight alcohol or alkanol, such as methanol, and water to promote the formation of a micellar dispersion of calcium carbonate.

Calcium hydroxide when used commercially as the sole reserve alkalinity agent in the reaction mixture is used in substantial excess in order to achieve a high TBN product.

The overbased amorphous calcium sulfonate is converted to the calcite-core overbased calcium sulfonate stable dispersion by;

(a) mixing the amorphous calcium sulfonate, a hydrocarbon solvent or oil (e.g., a 500 SUS oil), a $C_1$ to $C_5$ alkanol and water;

(b) heating the mixture of step (a);

(c) adding a $C_1$ to $C_6$ carboxylic acid or salt and water to the mixture; and (d) reacting the mixture at a temperature up to and commensurate with the boiling point of the solvent.

to convert the calcium sulfonate to a calcite-core micellar structure. The reaction usually takes about up to 1½ hours or more to fully convert to the calcite-core micellar calcium sulfonate. After the conversion is complete as determined by infra-red analysis. The product is stripped at 250° to 300° F., and then cooled to 180° to 200° F. The product is filtered to remove residues usually greater than 25 micron residual particles, and the viscosity adjusted to the desired level by the addition of a hydrocarbon solvent to form the final product. The calcite product has a low viscosity of less than 100,000 cps at 25° C. and a high TBN of 100 to 400. The viscosity is generally 20,000 to 30,000 cps at 25° C.

More specifically the present method provides for:

(a) charging the following components to a reactor:

| | parts (by weight) |
|---|---|
| overbased amorphous calcium sulfonate | 60 to 70 |
| a 70 to 2,000 SUS hydrocarbon solvent | 18 to 20 |
| $C_1$ to $C_5$ alkanol | 10 to 40 |
| water | 10 to 30; |

(b) heating and mixing the charge of step (a) to 140° to 150° F.;

(c) adding an acetic acid or calcium acetate, in an amount of 1 to 3 parts by weight;

(d) maintaining the reaction mixture of step (c) at a temperature below about the boiling point of the alkanol, and preferably methanol at 150° to 160° F., for up to 1½ hours or more to convert to a calcite-core calcium sulfonate;

(e) optionally, adding a dispersant;

(f) diluting the product with a hydrocarbon solvent to adjust the viscosity to below 100,000 cps at 25° C.; and (g) removing the wet alkanol to recover the product.

It is important to note that a dispersant is an optional component of the process and product for the calcite overbased detergent. A preferred dispersant is the reaction product of hydrocarbyl-substituted succinic acid or anhydride with amines containing at least one primary or secondary amino nitrogen, e.g., the polyalkylene polyamines fulfill this requirement as do the substituted polyalkylene polyamines, and for that matter, ammonia. The bis-succinimides are also useful as optional dispersants. The bis-succinimides are prepared by the reaction of hydrocarbyl-substituted succinic acid or anhydride with an amine containing at least two primary and/or secondary nitrogens. Such bis-succinimides are, for example, the polyisobutenyl bis-succinimides of ethylene diamine, diethylene traimine, or triethylene tetramine, or tetraethylene pentamine or N-methyldipropylene triamine, etc. (e.g., Benoit, U.S. Pat. No. 3,438,899). The various above-described dispersing agents can be used alone or in mixtures.

Calcite Calcium Sulfonate

The overbased calcite calcium sulfonate product of the present invention has a calcite-core micellar structure. The overbased calcite product while converted from the amorphous form is substantially free of the amorphous as well as the non-calcite crystalline forms of calcium carbonate, vaterite and aragonite. The overbased calcium sulfonate, or like overbased detergent, is a stable dispersion of calcite-core micelles.

The overbased calcite calcium sulfonate product has a TBN of at least about 100 to 400, and preferably 400 or more, and a low viscosity of less than 100,000 cps at 25° C. The viscosity is generally about 20,000 to 30,000 cps at 25° C. The calcium sulfonate content is at least from about 12 to 17% by weight or higher.

The calcite overbased calcium sulfonate of the present invention is soluble in oil, particularly including paraffinic and naphthenic oils, in amounts from 0.1 to 10% by weight and more at room temperature.

Engine Oil

The calcite overbased calcium sulfonate detergent of the present invention may be added to engine or lubricating oils in detergent amounts of about 0.1 to 10% by weight or more, and are soluble in such oils at room temperature.

The present invention finds that more than 1% by weight of calcite to be valuable substantially haze free improvement in the engine oil, whereas the prior could not tolerate small amounts of up to 1% calcite in an oil because of undesirable haze or incompatibility.

It has been found that because of the anti-wear effectiveness of the present detergent, the prior art amorphous detergent need only be replaced in part by the calcite detergent. That is, the detergent amount in the oil may be made up by a combination of the prior art amorphous detergent and the present oil soluble calcite overbased detergent, and the calcite detergent may be present in a lesser amount than the amorphous detergent, and still obtain the commercially desired anti-wear improvement.

A typical motor oil additives formulation is:

| additive | % by weight | % by weight range |
|---|---|---|
| ashless dispersant | 7.5 | 5-10 |
| overbased detergents | 4.0 | 1-6 |
| antioxidant | 0.6 | 0.1-2.5 |
| zinc dithiophosphate | 1.3 | 0.08-.14% P |

It is with the contemplation of the present invention that the present calcite overbased detergent will replace part if not all of the overbased detergents in a typical motor oil additive package. That is, the motor oil industry may preferably desire to replace only part of the prior art amorphous detergent with the present calcite overbased detergent, and still achieve the desired anti-wear improvement. The motor oil detergents may be a combination of sulfonates, phenates and salicylates, and like known overbased detergents.

It is anticipated that the presence of the calcite overbased detergent of the present invention in an engine oil would reduce the ZDP requirement and yet still achieve the desired commercial level of anti-wear. That is, it is expected that a motor oil which contained the calcite-core overbased detergent of the present invention with less than the presently mandated 0.1% P ZDP would nonetheless have a 4-Ball test (ASTM D4172) scar diameter of less than about 0.4 mm.

Hazitron Test

The Hazitron instrument and test is a trade recognized determination of haze levels in oil compositions. The Hazitron instrument is used to give a relative indication of light scattering caused by haze. The method is based on measurements of transmitted light by the sample placed in two positions of the sample compartment. A cuvette filled with the sample is placed in the extreme right side of the sample compartment, adjacent to the measuring photocell and the instrument is balanced with the numbered dial set on "0". The cuvette is then shifted to the extreme left side of the sample compartment and the instrument is re-balanced using the numbered dial. The reading on the numbered dial minus the cuvette correction number gives the Hazitron number. The higher the number the hazier the sample. The Hazitron instrument commercial test procedures and significance of the results are discussed in Migdal, et al., U.S. Pat. No. 5,075,383; Kapuscinski, et al., U.S. Pat. No. 5,474,693; and Russo, et al., U.S. Pat. No. 5,219,482. The trade recognized that Hazitron test values of generally less than about 30, and more usually and preferably less than about 15 to 10 indicated that the oil had a commercially tolerable level of haze or was essentially haze free.

Turbidity Test

Turbidity is measured on a standard turbidimeter, such as a Hach 2100 AN or 2100 N turbidimeter. The lubrication art recognized that an engine oil which had a turbidimeter value of below 40 to 60 and preferably less than about 25 had commercially acceptable levels of haze or was essentially haze free.

4-Ball Wear Test

The 4-Ball test (ASTM D4172), is an art recognized test for determining anti-wear characteristics. The test measures a wear scar diameter in a metal surface. The 4-Ball test as used herein in the specification, and in the claims, unless otherwise specified, is where there is 40 kg load, for 60 minutes, at 1200 rpm, at 75° C. The lubrication art recognized that an oil that caused a 4-Ball test scar diameter of less than about 0.4 mm. signified or qualified as an oil having commercial level anti-wear characteristics.

Timken Lubricity Test

This lubricity test is also referred to as the Retention Test or the United States Steel Method by the Timken Lubricant Tester. The test procedure is as follows:

The Timken test cup and block are washed with a petroleum spirit and dried at room temperature prior to assembly. Care is exercised in adjusting the lever arm and in tightening the test cup to avoid distortion or misalignment.

Four grams of sample are weighed on a watch glass to the nearest 0.5 gram. The entire amount is applied by spatula to the bearing surface of the test cup and block.

The test is started by simultaneously checking time and applying the lever arm load by means of an automatic loading device.

The test is stopped by any one of the following observations indicating a failure point:

1. Appearance of the lubricant film on the test cup (A line break in the film indicates approaching failure 200 to 300 seconds prior to destruction of the entire film).

2. Machine chatter caused by dry metal.
3. Smoke, overheating, or sounds that indicate dry metal pick up.

The data reported show a pass or the longest single time recorded in the three tests. A pass is considered two thirty-minute tests out of three.

This procedure currently applies only to gearshield-type lubricants above 750 SUS at 210° F. for spraying open gears or the equivalent. The test in connection with the present invention is run under a 10-pound lever load at 800 rpm. The Timken mandrel should cool for two hours between test runs to assure a uniform starting temperature.

Extreme Pressure Load Carrying Test

The Extreme Pressure or Falex Pin and Vee Block test (ASTM D3233-86) is an art recognized test for measuring load bearing characteristics of fluid lubricants or oils.

The following Examples illustrate the invention:

EXAMPLE 1 (Calcite Conversion)

This example demonstrates the method of preparing the oil soluble calcite-core overbased calcium sulfonate detergent of the present invention using calcium acetate. The following components were charged to a reactor equipped with heating, mixing, stirring and condensing capabilities:

| component | parts (by weight) |
|---|---|
| overbased amorphous calcium sulfonate (TBN 400) | 65.2 |
| 500 SUS base oil | 26.0 |
| methanol | 13.1 |
| water | 13.1 |

The components were mixed and heated to 145° F. The mixture was further mixed, and the following component added:

| | parts (by weight) |
|---|---|
| calcium acetate | 2.5 |

After the addition of the calcium acetate, the mixture was further mixed and the temperature maintained at 150° to 160° F. for 1 to 1½ hours, at which time conversion was complete as confirmed by infra-red analysis. The reaction product was then diluted by the following addition:

| | parts (by weight) |
|---|---|
| 100 SUS base oil | 6.3 |

The diluted reaction product was stripped at 300° F. to remove the volatile components, and cooled to 180° to 200° F. The product was recycled through a filter bag to remove any solid contaminants, and then the product viscosity was adjusted.

The detergent product from Example No. 1 was found by analysis to have a calcite-core micellar structure. The Example No. 1 calcite detergent product had the following properties:

| | |
|---|---|
| TBN | 265 |
| viscosity | 25,000 cps at 25° C. |
| $(RSO_3)_2$ Ca (calcium sulfonate) | 12.3% by weight |

EXAMPLE 2 (Calcite Conversion)

This example demonstrates the method of preparing the oil soluble calcite-core overbased calcium sulfonate detergent of the present invention using acetic acid. The following components were charged to a reactor equipped with heating, mixing, stirring and condensing capabilities.

| component | parts by weight |
|---|---|
| overbased amorphdus calcium sulfonate (TBN 400) | 66.0 |
| neutral base oil 500 SUS | 26.0 |

The above components were blended and heated to 140° F. The following components were then added:

| | |
|---|---|
| water | 26.8 |
| acetic acid (92%) | 2.5 |

The foregoing components were blended and the temperature adjusted to 150° F. The following component was added:

| | |
|---|---|
| methanol | 36.6 |

The foregoing components were blended and the temperature maintained at 150° to 160° F. for 120 minutes. Complete conversion was confirmed by infra-red analysis. Volatile components were then removed by heating to 300° F., which temperature was maintained for 1 hour. The product was cooled, and the viscosity adjusted with the hydrocarbon solvent base oil in 5 parts by weight.

The Example No. 2 calcite detergent product had the following properties:

| | |
|---|---|
| TBN | 250 |
| viscosity | 27,000 cps at 25° C. |
| $(RSO_3)_2$ Ca | 12.5% by weight |

EXAMPLE 3 (Anti-Wear)

This example demonstrates a scaled up pilot run based on acetic acid. The following components were added to a reactor with mixing, heating, stirring and condensing capabilities.

| component | weight (lbs.) |
|---|---|
| overbased amorphous calcium sulfonate (TBN 400) | 1,320 |
| neutral base oil (500 SUS visc.) | 520 |

The reactor and the vents were closed and the reflux condenser set up. The mixture was heated to 160° F., and the following components added:

| | |
|---|---|
| water | 535 |
| acetic acid | 50 |

The foregoing mixture was mixed for 15 minutes and the temperature adjusted to 150° F., and the following component added:

| | |
|---|---|
| methanol | 732 |

The resultant mixture was mixed and the temperature maintained between 150 to 160° F. The conversion to calcite was complete after 90 minutes as confirmed by infra-red analysis. The reactor vents were opened and the solvents removed by heating the product to 280° F. and maintaining a temperature in excess of 280° F. for 1 hour. The viscosity was adjusted using the base oil (hydrocarbon solvent).

The Example 3 product had the following properties:

| | |
|---|---|
| TBN | 246 |
| viscosity | 25,000 cps at 25° C. |
| $(RSO_3)_2$ Ca | 12.5% by weight |

EXAMPLE 4 (Haze)

This example compares haze characteristics of prior art amorphous-core overbased calcium sulfonate, calcite-core overbased calcium sulfonates of this invention and prior art commercial calcite-core overbased calcium sulfonates.

| Sample Structure | TBN | Calcium Sulfonate wt. % | Hazitron 5% by wt. in paraffin oil | Turbidity 5% by wt. in paraffin oil | Oil Solubility (visual) 10% by wt. in paraffin oil |
|---|---|---|---|---|---|
| Amorphous | 405 | 20 | 6 | 20 | Clear & Bright |
| Example 1 | 265 | 12.3 | 7.1 | 97 | Slight Haze |
| Example 3 | 246 | 12.5 | 11.3 | 119 | Slight Haze |
| Witco S700[1] | 245 | 23.0 | >100 | >200 | Heavy Haze |
| Witco G2015[2] | 260 | 13.0 | >100 | >200 | Haze |

[1] Witco S700 is a commercially available overbased calcite-core calcium sulfonate detergent.
[2] Witco G2015 is a commercially available overbased calcite-core calcium sulfonate detergent.

EXAMPLE 5 (Anti-Wear)

This example demonstrates the anti-wear performance improvement of a formulated oil with and without the addition of the products of Examples 1 and 3. The test was carried out in a four-ball test machine according to ASTM D4172 procedures. The load was 40 kg. at 1200 rpm for 60 min., at 75° C. The wear results for several commercial formulated oils as well as commercial oil containing the products of Examples 1 and 3 are tabulated below.

| Formulated Oil | Invention Additive (5% by wt.) | Scar Diameter (mm) |
|---|---|---|
| Castrol GTX 10W30 | — | 0.54 |
| Valvoline 10W30 | — | 0.50 |
| Quaker State 10W30 | — | 0.49 |
| Esso Protect Extra 10W30 | — | 0.41 |
| Penzoil 10W30 | — | 0.45 |
| Castrol GTX 10W30 | Example 1 | 0.39 |
| Castrol GTW 10W30 | Example 3 | 0.38 |

The foregoing demonstrates that the addition of 5% by weight of the calcite-core overbased detergent product of the present invention provides the less than 0.4 mm 4-Ball scar diameter desired anti-wear improvement.

EXAMPLE 6 (Lubricity)

This test demonstrates the lubricity characteristics of the additives of this invention under severe conditions. The test procedure used is the previously described U.S. Steel Retention test whereby the test oil with or without additives is placed in the test cup, using the Timken machine under a load of 10 lbs. Failure occurs when smoke and chattering occurs.

| Sample | Additive (at 1% by wt.) | Time to Failure (hrs.) |
|---|---|---|
| Neutral Paraffin Oil | Nil | <1 hr. |
| Neutral Paraffin Oil | Oloa 269R (zinc dialkyl dithiophosphate) | 1½ hrs. |
| Neutral Paraffin Oil | Witco HYBASE C402 (overbased calcium sulfonate, amorphous) | 4 hrs. |
| Neutral Paraffin Oil | Witco LOBASE C4502 (neutral calcium sulfonate) | <1 hr. |
| Neutral Paraffin Oil | Example 1 | >12 hrs. |
| Neutral Paraffin Oil | Example 3 | >12 hrs. |

The results of Example 6 demonstrate that the addition of only 1% by weight of the calcite-core overbased calcium sulfonate of the present invention provides greatly improved severe conditions lubricity.

EXAMPLE 7 (Load Carrying)

This test demonstrates the load carrying properties of the product of this invention using the Falex Pin and Vee Block test method, ASTM D3233. The below data reports the maximum load to failure. Failure is a break or seizure of the pin or journal. If there is no failure, the report reads as "4500 lbs. Pass."

| Sample | Additive | Falex Load (lbs.) |
|---|---|---|
| Neutral Paraffln Oil | Nil | 1000 Fail |
| Neutral Paraffin Oil | Witco HYBASE C402 (amorphous overbased | |

-continued

| Sample | Additive | Falex Load (lbs.) |
|---|---|---|
| | calcium sulfonate) | |
| | at 8 TBN | 1500 Fail |
| | at 16 TBN | 2250 Fail |
| | at 32 TBN | 4500 Pass |
| Neutral Paraffin Oil | Example 1 | |
| | at 8 TBN | 4500 Pass |
| | at 16 TBN | 4500 Pass |
| | at 32 TBN | 4500 Pass |
| Neutral Paraffin Oil | Example 2 | |
| | at 8 TBN | 4500 Pass |
| | at 16 TBN | 4500 Pass |
| | at 32 TBN | 4500 Pass |

EXAMPLE 8 (Anti-Wear)

This example demonstrates the effectiveness of wear control at particularly low concentrations of additives in an oil. The 4-Ball wear tester (ASTM D4172) was used for these tests at 1200 rpm for 60 min. at 75° C.

The result are tabulated below.

| Sample | Additive | Load (kg) | Scar Diameter (mm.) 8 TBN; 16 TBN; 32 TBN |
|---|---|---|---|
| Neutral Paraffin Oil | Nil | 20 | 0.76 |
| | | 40 | 0.97 |
| | | 60 | — |
| Neutral Paraffin Oil | Witco C402[1] | 20 | 0.4; 0.35; 0.29 |
| | | 40 | 1.34; 0.51; 0.39 |
| | | 60 | - - - ; - - - ; 1.50 |
| Neutral Paraffin Oil | Example 1 | 20 | 0.28; 0.35; 0.35 |
| | | 40 | 0.60; 0.38; 0.35 |
| | | 60 | 0.60; 0.56; 0.50 |
| Neutral Paraffin Oil | Example 2 | 20 | 0.40; 0.34; 0.34 |
| | | 40 | 0.57; 0.36; 0.39 |
| | | 60 | 0.70; 0.53; 0.44 |

[1]Witco HYBASE C402 is a 400 TBN amorphous overbased calcium sulfonate.

Example 8 demonstrates the improvement in anti-wear at particularly low concentrations and varius loads, by the presence of varying amount of calcite-core overbased calcium sulfonate as compared with an oil without detergent and with a 400 TBN amorphous overbased calcium sulfonate detergent.

While the foregoing Examples employed acetic acid or calcium acetate as the conversion agent, it is understood and within the contemplation that any $C_1$ to $C_6$ carboxylic acid or salt may be used.

While the foregoing Examples were disclosed in the context of an overbased calcium sulfonate, it is within the contemplation of this invention to provide like haze free calcite-core micelles in phenates, salicylates, and like known overbased detergents.

What is claimed is:

1. An engine oil comprising;

a lubricating oil, and an overbased calcium sulfonate detergent comprising calcite, wherein the engine oil is substantially haze free.

2. The engine oil of claim 1, comprising from 0.1 to 10% by weight of said detergent.

3. The engine oil of claim 1, said detergent having a TBN of 100 to 400 and a viscosity of no more than 100,000 cps at 25° C.

4. The engine oil of claim 3 having a calcium sulfonate content of from about 12 to 17% by weight.

5. The engine oil of claim 1, said detergent being substantially free of amorphous calcium carbonate, vaterite and aragonite.

6. The engine oil of claim 1, wherein the engine oil has a Hazitron test value of less than about 15.

7. The engine oil of claim 1, wherein the engine oil has a 4-Ball wear test scar diameter of less than about 0.4 mm.

8. The engine oil of claim 1, said detergent being substantially free of amorphous calcium carbonate, said detergent being present in an amount of about 0.1 to 10% by weight, said detergent having a TBN of 100 to 400 and a viscosity of no more than 100,000 cps at 25° C., and wherein the engine oil has a Hazitron test value of less than about 15, and has a 4-Ball wear test scar diameter of less than about 0.4 mm.

9. The engine oil of claim 1, said detergent being present in an amount of from about 0.1 to 10% by weight.

10. The engine oil of claim 1, further comprising a second detergent comprising amorphous micelles, and wherein the second detergent is present in a greater amount than said first detergent, and wherein the first and second detergents in combination are present in a detergent amount.

11. The engine oil of claim 10, said first detergent being present in an amount of from about 0.1 to 10% by weight.

12. The engine oil of claim 1, having a turbidimeter value below 60 NTU.

13. The engine oil of claim 1, wherein the engine oil comprises an automotive crankcase oil.

14. The engine oil of claim 1, wherein the engine oil passes the Timken lubricity test in passing at least two thirty-minute tests out of three.

15. The engine oil of claim 1, wherein the lubrication oil comprises a motor oil, and wherein the 4-Ball wear test scar diameter of the engine oil is less than the 4-Ball wear test scar diameter of the lubrication oil without the detergent.

16. The engine oil of claim 15, wherein the detergent is present in a detergent amount.

17. The engine oil of claim 1 wherein the engine oil has a turbidimeter value of less than about 25 NTU.

18. The engine oil of claim 17, wherein the engine oil passes the Falex Pin and Vee Block test (ASTM D3233).

19. A method for making a calcite overbased detergent comprising:

(a) mixing a formulation consisting essentially of an amorphous calcium carbonate overbased sulfonate detergent, a hydrocarbon solvent, a $C_1$ to $C_5$ alkanol, and water;

(b) heating the mixture of step (a);

(c) adding at least one of a $C_1$ to $C_5$ carboxylic acid and salt thereof to the mixture of step (a); and (d) maintaining the mixture of step (c) at a temperature up to and commensurate with the boiling point of the hydrocarbon solvent to convert the amorphous calcium carbonate to calcite.

20. The method of claim 19, further comprising (e) diluting the product of step (d) with said hydrocarbon solvent.

21. The method of claim 20, further comprising (f) stripping the product of step (e).

22. The method of claim 19, wherein the carboxylic acid comprises acetic acid.

23. The method of claim 19, wherein the salt comprises calcium acetate.

24. The method of claim 19, wherein the mixture of step (a) comprises the following indicated amounts of said:

| | Parts by weight |
|---|---|
| overbased sulfonate detergent | 50 to 100 |
| hydrocarbon solvent | [0] up to 50 |
| alkanol | 10 to 40 |
| water | 10 to 30 |

and wherein in step (c) said carboxylic acid is employed in an amount of 1 to 6 parts by weight.

25. The method of claim 19, wherein:

said overbased sulfonate detergent is present in an amount of 60 to 70 parts by weight;

said solvent comprises an SUS 500 oil and is present in an amount of 20 to 30 parts by weight;

said alkanol comprises methanol and is present in an amount of 30 to 40 parts by weight:

said water is present in an amount of 15 to 20 parts by weight;

and wherein said at least one of said carboxylic acid and salt thereof is selected from the group consisting of acetic acid and calcium acetate and is present in an amount of 1 to 6 parts by weight.

26. The method of claim 25, wherein the temperature of step (d) is 150° to 160° F.

27. The method of claim 25, wherein the temperature of step (b) is 140° to 150° F.

28. The method of claim 25, wherein step (d) is for 1 to 1½ hours.

29. The method of claim 25, wherein the product of step (d) comprises essentially a calcite-core micellar structure.

30. The method of claim 25, wherein the product of step (d) is substantially free of amorphous calcium carbonate, vaterite and aragonite.

31. An overbased calcium sulfonate detergent comprising a dispersion of calcite micelles in a hydrocarbon oil, the dispersion, when formulated in paraffin oil at a level of at least 1% calcite, providing a composition characterized by a Hazitron test value of less than 30.

32. The detergent of claim 31, said detergent being substantially free of amorphous calcium carbonate, vaterite and aragonite.

33. The detergent of claim 31, said detergent having a TBN of 100 to 400 and a viscosity of no more than 100,000 cps at 25° C.

34. The detergent of claim 31 having a calcium sulfonate content of about 12 to 17% by weight.

35. An engine oil formulation comprising a detergent dispersion as in claim 31.

36. An engine oil formulation as in claim 35 wherein said detergent is present in an amount of about 0.1 to 10% by weight of said formulation.

37. An engine oil formulation as in claim 35 wherein said detergent is present in an amount providing said formulation with 1% or more of calcite.

38. An engine oil comprising:

a lubricating oil;

an overbased calcium sulfonate detergent comprising calcite; and less than 0.1% by weight of phosphorous (P) from zinc dithiophosphate;

wherein the engine oil is substantially haze free and has a 4-Ball test (ASTM D4172) scar diameter of less than about 0.4 mm.

39. The engine oil of claim 38, said detergent having a TBN of 100 to 400 and a viscosity of no more than 100,000 cps at 25° C.

40. The engine oil of claim 39, wherein the engine oil has a Hazitron test value of less than about 15.

* * * * *